United States Patent [19]

Van de Loock

[11] 4,032,078

[45] June 28, 1977

[54] REEL FOR THE STORAGE OF WIRE OR THE LIKE

[75] Inventor: Guido Van de Loock, Hemiksem, Belgium

[73] Assignee: S. A. Bekaert-Cockerill, N.V., Hemiskem, Belgium

[22] Filed: May 13, 1976

[21] Appl. No.: 686,007

[30] Foreign Application Priority Data

May 20, 1975 United Kingdom ..... 21682/75

[52] U.S. Cl. ..... 242/77.2

[51] Int. Cl.[2] ..... B65H 75/20

[58] Field of Search ..... 242/77.2, 77, 77.3, 242/129, 115, 118.8

[56] References Cited

UNITED STATES PATENTS

| | | | |
|---|---|---|---|
| 1,540,836 | 6/1925 | Hedderich | 242/77.2 |
| 1,844,494 | 2/1932 | Anderson | 242/77.2 |
| 2,965,327 | 12/1960 | Blary | 242/77.2 |
| 3,977,622 | 8/1976 | Fecher | 242/77.2 |

*Primary Examiner*—Edward J. McCarthy
*Attorney, Agent, or Firm*—Edward J. Brenner

[57] ABSTRACT

A reel for the storage of wire or the like which comprises a number of elements each made of a single piece of metal wire bent to form a segment of the reel and all joined together in a circular array, particularly by being secured together by spot welding. The elements may be formed to provide (1) two mutually opposite portions of respective rims of the reel, (2) side members extending inwardly from the rims, and (3) at least one of a ring of bearing members extending transversely between the side members to receive the wire or the like to be wound on the reel.

7 Claims, 4 Drawing Figures

REEL FOR THE STORAGE OF WIRE OR THE LIKE

This invention relates to reels for the storage of wire or like elongated material, and has its object to provide a reel of simple construction which may be formed entirely of metal wire.

According to the invention there is provided a reel for the storage of wire or the like, which comprises a number of elements each made of a single piece of metal wire bent to form a segment of the reel and all secured together in a circular array by spot-welding.

In a preferred form of the invention each of said elements is formed to provide two mutually opposite portions of respective rims of the reel, side members extending inwardly from said rims, and at least one of a ring of bearing members extending transversely between said side members to receive wire or the like to be wound on the reel.

As will be clear from the following detailed description, such a construction enables the reel to be so formed that no cut ends of wire, or welding burrs resulting from butt welding, are located where they might injure a user or damage the material to be stored on the reel.

Figure 1:
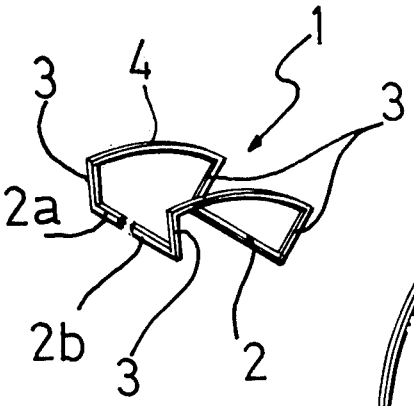
Figure 2:
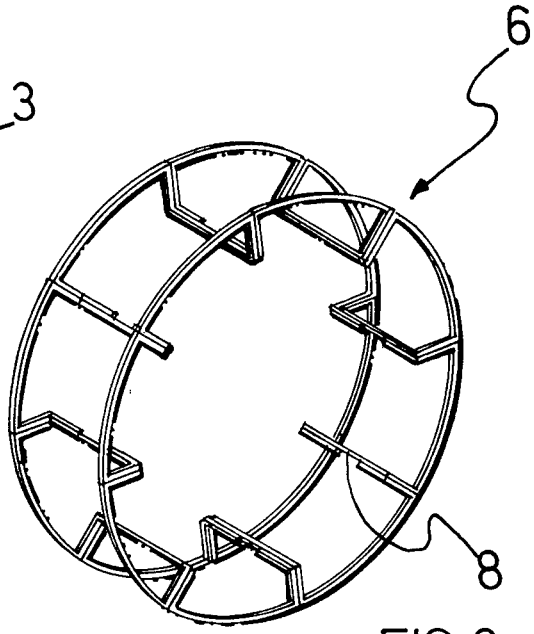
Figure 3:
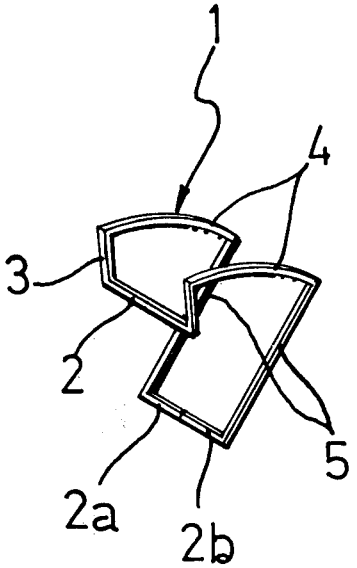
Figure 4:
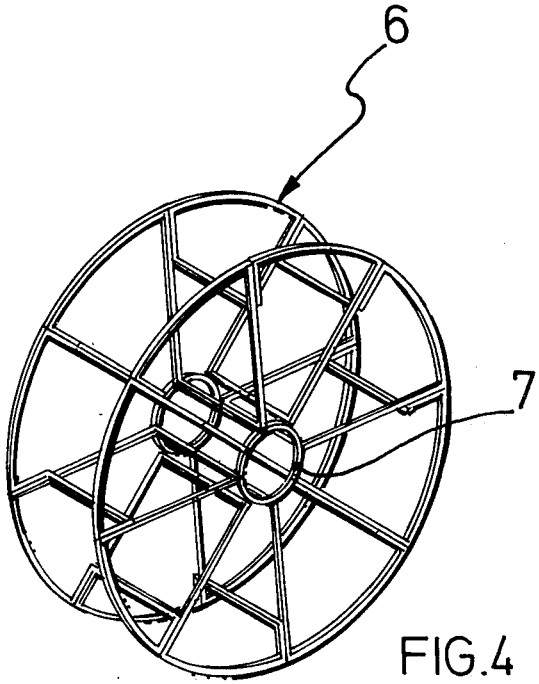

Some embodiments of the present invention will hereinafter be described, by way of example, with reference to the accompanying drawings, in which:

FIG. 1 shows a perspective view of an element of a reel made from a single length of wire, FIG. 2 shows a reel constructed from a plurality of elements as in FIG. 1, FIG. 3 shows a perspective view of a further element made from a single length of wire, and FIG. 4 shows a reel constructed from a plurality of elements as in FIG. 3.

FIG. 1 shows a three-dimensional element 1 made from a single piece of metal wire. To construct the element 1 a length of steel wire is first bent to form a planar rectangle with the two ends 2a, 2b of the wire extending along one of the shorter sides of the rectangle. The two ends of the wire are not joined together and in the embodiment illustrated a gap is left therebetween. The rectangle is then bent out of its original plane along an axis parallel to its shortest dimension at two points along its longest dimension into a substantially U-shaped configuration having two mutually opposite portions 4 of respective rims of the reel and side members 3 extending inwardly from said rim portions. A transverse member, formed by a shorter side 2 or **2*a*, 2*b* of the rectangle, extends between two opposite side members 3. Each rim portion 4 has a side member 3 extending radially inwardly from each of its ends, and in the embodiment illustrated the two side members 3 associated with each rim portion 4 subtend an angle of 45° therebetween. As is shown in FIG. 1 the rim portions 4 are arcuate so that the rims of the reel constructed from the elements 1 are circular. Alternatively the rim portions 4 may be bent into several parts at an obtuse angle with respect to each other. In this case the rims of the reel will be polygonal. In the embodiment of FIG. 1 the side members 3** are all equal in length.

FIG. 2 shows a reel 6 which has been constructed by spot-welding a plurality of the elements 1 of FIG. 1 together in a circular array. As the side members 3 of the element 1 of FIG. 1 subtend an angle of 45°, eight such elements 1 are used to form the reel 6. The transverse members of each element 1 are spot-welded to a transverse member of an adjacent element 1 to form a ring of axially extending bearing members 8. The side members 3 are also spot-welded together. The two ends **2*a*, 2*b* of each wire forming an element 1 are arranged coaxially in one of the bearing members and are not joined together. The wire or the like to be wound on the reel 6 is carried by the bearing members 8. As no butt-welds are used in the formation of the reel 6 no welding burrs are produced. It will thus be seen that there are no burrs on the bearing members 8 nor on any part of the reel 6** which will be handled.

The diameter of the ring of bearing members 8 of the reel of FIG. 2 is equal to at least half of the total diameter of the reel and the reel is hollow inwardly of the ring of bearing members. Wire or other material is wound on or unwound from such a reel as that shown in FIG. 2 by means of known machines in which at least two cooperating parts are provided between which the reel is clamped.

FIG. 3 shows a perspective view of a further embodiment of a three-dimensional element 1. A plurality of such elements are spot-welded together to form a reel 6 as illustrated in FIG. 4 having a central bearing. The element 1 of FIG. 3 is formed in a similar manner to the element 1 of FIG. 1 from a single piece of metal wire. A length of steel wire is first bent to form a planar rectangle with the two ends **2*a*, 2*b* of the wire extending along one of the shorter sides. The two ends of the wire are then butt-welded together. The rectangle is then bent out of its original plane into a substantially U-shaped configuration having two mutually opposite portions 4 of respective rims of the reel and side members 3 and 5 extending inwardly from the rim portions 4. A transverse member forming a bearing member of the reel extends between opposite side members 3 and the other transverse member, including the two ends of the wire extends between opposite side members 5. The side members 5 are longer than the side members 3.**

FIG. 4 shows a reel 6 which has been constructed by spot-welding a plurality of elements 1 of FIG. 3 together in a circular array. The transverse member extending between the opposite side members 5 is spot-welded at either end thereof to two rings 7 to form a central bearing for the reel 6 close to the reel axis. The opposite side members 3 of each element 1 are spot-welded to the side members 5 of an adjacent element 1 so that the transverse members extending between the pairs of side members 3 form the axially extending bearing members 8. It will be seen that the two ends of each piece of wire forming an element which have been butt-welded together are arranged coaxially in the transverse members which are located inwardly of the ring of bearing members. Thus, there are no welding burrs on the ring of bearing members nor on any part of the reel which will be handled.

A reel can also be constructed using both elements of the type illustrated in FIG. 1 and of the type illustrated in FIG. 3. In this case the two types of elements are preferably spot-welded together alternately.

Preferably, the wire used in the formation of elements 1 has a square, rectangular or flattened cross-section as thus makes the spot-welding of the wire easier.

As the reels 6 described above are constructed from metal wire they are easier to dispose of when no longer required than are reels made of plastics material. There are no welding burrs or other projections on either the ring of bearing members or on any part of the reel which will be handled which could damage the material carried on the reel or cause injury to persons handling the reel. Additionally, as each reel is made from a limited number, for example, four, six or eight, of elements which each have a stable three-dimensional shape, the reels can be constructed easily, especially if the wire used to form the elements has a flattened cross-section so that spot-welding the wire is relatively easy.

The formed reels have a low weight but are nevertheless strong and they can be manufactured at a low cost.

What I claim is:

1. A reel for the storage of wire or the like which comprises a number of elements each made of a single piece of metal wire bent to form a segment of the heel and all joined together in a circular array, each of said elements being formed to provide two mutually opposite portions of respective rims of the reel, each of said rim portions having a side member extending radially inwardly from each of its ends, and a transverse member extending between each opposed pair of said side members, at least one of such transverse members constituting a bearing member of a ring of bearing members for the wire to be wound on the reel, the elements being spot-welded together.

2. A reel as claimed in claim 1 wherein each of said elements is formed from a rectangle of wire bent out of its original plane into a substantially U-shaped configuration.

3. A reel as claimed in claim 1 wherein each of at least some of said elements includes two of said bearing members each constituted by one of said transverse members, the two ends of the wire which forms the element being arranged coaxially in one of said bearing members but not being joined together.

4. A reel as claimed in claim 1 wherein each of at least some of said elements includes only one of said bearing members, the other of said transverse members being located inwardly of the ring of bearing members and close to the reel axis, the two ends of the wire which forms the element being arranged coaxially in the latter transverse member and being butt-welded together.

5. A reel as claimed in claim 1 wherein the wires forming the said elements are of square section.

6. A reel as claimed in claim 1 wherein the said rim portions are arcuate and the rims are circular.

7. A reel as claimed in claim 3 wherein the diameter of the said ring of bearing members is equal to at least half of the total diameter of the reel, and the reel is hollow inwardly of the said ring of bearing members.

* * * * *